US011965435B2

(12) United States Patent
Von Gaisberg-Helfenberg et al.

(10) Patent No.: US 11,965,435 B2
(45) Date of Patent: Apr. 23, 2024

(54) BEARING ASSEMBLY OF CAMSHAFTS ON A CYLINDER HEAD OF AN INTERNAL COMBUSTION ENGINE

(71) Applicant: Mercedes-Benz Group AG, Stuttgart (DE)

(72) Inventors: Alexander Von Gaisberg-Helfenberg, Beilstein (DE); Thomas Stolk, Kirchheim (DE)

(73) Assignee: Mercedes-Benz Group AG, Stuttgart (DE)

( * ) Notice: Subject to any disclaimer, the term of this patent is extended or adjusted under 35 U.S.C. 154(b) by 0 days.

(21) Appl. No.: 18/007,515

(22) PCT Filed: May 19, 2021

(86) PCT No.: PCT/EP2021/063281
§ 371 (c)(1),
(2) Date: Dec. 1, 2022

(87) PCT Pub. No.: WO2021/244850
PCT Pub. Date: Dec. 9, 2021

(65) Prior Publication Data

US 2023/0212962 A1 Jul. 6, 2023

(30) Foreign Application Priority Data

Jun. 2, 2020 (DE) ..... 10 2020 003 283.4

(51) Int. Cl.
*F01L 1/047* (2006.01)
*F01L 1/053* (2006.01)

(52) U.S. Cl.
CPC ..... *F01L 1/047* (2013.01); *F01L 2001/0476* (2013.01); *F01L 2001/0537* (2013.01); *F01L 2303/01* (2020.05)

(58) Field of Classification Search
CPC ..... F01L 1/047; F01L 2001/0476; F01L 2001/0537; F01L 2303/01
See application file for complete search history.

(56) References Cited

U.S. PATENT DOCUMENTS 8,689,755 B2 4/2014 Schneider et al.
2015/0034030 A1* 2/2015 Schnoelzer ..... F01L 1/047 123/90.6

FOREIGN PATENT DOCUMENTS

DE 10 2010 024 721 A1 3/2012
DE 102011121860 A1 * 6/2013 ..... F01L 1/047
(Continued)

OTHER PUBLICATIONS

PCT/EP2021/063281, International Search Report dated Aug. 26, 2021 (Two (2) pages).

*Primary Examiner* — Audrey B. Walter
(74) *Attorney, Agent, or Firm* — Crowell & Moring LLP

(57) ABSTRACT

An apparatus includes a bearing assembly of a first camshaft and a second camshaft on a cylinder head of an internal combustion engine. The first camshaft has a first recess where a tool is insertable into the first recess and the second camshaft has a second recess where the tool is insertable into the second recess. A cylinder head hood is attached to the cylinder head where the cylinder head hood has a first through-opening matched with the first recess and a second through-opening matched with the second recess. A first wall area of the cylinder head hood that at least partially delimits the first through-opening and a second wall area of the cylinder head hood that at least partially delimits the second through-opening are disposed at different heights.

4 Claims, 1 Drawing Sheet

(56) References Cited

FOREIGN PATENT DOCUMENTS

| | | | | |
|---|---|---|---|---|
| DE | 20 2015 105 757 U1 | 3/2016 | | |
| DE | 202015105757 U1 * | 3/2016 | ..... | F01L 1/047 |
| DE | 20 2015 008 502 U1 | 4/2017 | | |
| DE | 102016217356 B4 * | 2/2021 | ..... | F01L 1/04 |
| EP | 3 296 528 A1 | 3/2018 | | |

* cited by examiner

BEARING ASSEMBLY OF CAMSHAFTS ON A CYLINDER HEAD OF AN INTERNAL COMBUSTION ENGINE

BACKGROUND AND SUMMARY OF THE INVENTION

The invention relates to a bearing assembly of camshafts on a cylinder head of an internal combustion engine.

A camshaft for an internal combustion engine as well as such a bearing assembly of camshafts on a cylinder head of an internal combustion engine are already to be taken as known, for example from DE 20 2015 008 502 U1. In the bearing assembly, the respective camshaft is mounted rotatably on the cylinder head. Each camshaft also has a recess that is formed in a respective outer periphery of the outer surface of the respective camshaft and opens outwards in the radial direction of the respective camshaft, into which recess a tool can be inserted and can thereby be brought into positive cooperation with the respective camshaft. Thus, for example, a torque can be transferred between the tool and the camshaft, so that the respective camshaft can be secured against rotating, in particular occurring relative to the cylinder head, by means of the tool.

Furthermore, DE 10 2010 024 721 A1 discloses a cam for a camshaft for an internal combustion engine, wherein the cam has an axial extension with a retaining contour that is suitable for a retaining tool. Furthermore, a device for building and positioning a camshaft of an engine is known from DE 20 2015 105 757 U1.

It is the object of the present invention to further develop a bearing assembly of the kind mentioned at the start in such a way that an especially easy assembly can be achieved.

In order to further develop a camshaft in such a way that an especially easy assembly can be achieved, it is provided that the recess is arranged offset from the center of the camshaft in the radial direction. The center of the camshaft should in particular be understood to be that of its longitudinal axis or longitudinal central axis, which, for example, coincides with an axis of rotation around which the camshaft is rotatably mounted on a cylinder head of the internal combustion engine, which is preferably formed as a reciprocating piston engine.

Advantageously, the wall areas that delimit the recess in an imaginary section perpendicular to the camshaft through the recess, are differently dimensioned relative to their height and/or wall thickness and thus are dimensioned for optimized load-bearing capacity. The mass of the camshaft can thereby be kept low.

In order to further develop a bearing assembly of the kind specified herein in such a way that an especially easy assembly of the internal combustion engine can be achieved, it is provided that the respective recess is arranged offset from the respective center of the respective camshaft in the radial direction. Advantages and advantageous embodiments of the camshaft according to the invention are to be considered as advantages and advantageous embodiments of the bearing assembly according to the invention, and vice versa.

The following knowledge in particular underlies the invention: A camshaft for an internal combustion engine can have level surfaces on both sides of its outer periphery, which form a so-called dihedral. This means that the level surfaces are, for example, arranged in the radial direction of the camshaft on sides of the camshaft that are opposite each other or facing away from each other. A tool in the shape of an open-ended spanner can be attached on the dihedral, i.e., on the level surfaces, whereby the tool in the shape of an open-ended spanner can be brought into positive cooperation with the camshaft. A torque can thereby be transferred between the tool in the shape of an open-ended spanner and the camshaft, whereby the camshaft can be secured against rotating relative to the cylinder head. This is then for example advantageous if a camshaft adjuster, which is also referred to as a phase adjuster, is screwed onto the camshaft, in particular on the front face. The camshaft is thereby held still by means of the tool, in order to avoid a rotation of the camshaft when the phase adjuster is being screwed onto the camshaft, or in order to twist a screw element, by means of which the camshaft adjuster is screwed onto the camshaft, relative to the camshaft, and thereby to be able to fasten it to the camshaft.

Typically, a cylinder head hood is fitted to the cylinder head and on the camshaft. In order to be able to bring the tool into the previously described positive cooperation with the camshaft, without having to disassemble the cylinder head hood, the cylinder head hood typically has a through-opening, which is formed on a top of the cylinder head hood, which is also simply referred to as the hood. The through-opening is an opening to help with assembly, through which the tool can engage. Since, for example, at least or exactly two camshafts are mounted rotatably on the cylinder head, wherein for example each of the camshafts has a dihedral, the cylinder head hood has an opening to help with assembly per dihedral, so the cylinder head hood can have two openings to help with assembly. If the previously described dihedral and the tool in the shape of an open-ended spanner, also referred to as an open-ended spanner, are used in order to secure the respective camshaft against rotation, then the respective opening to help with assembly must be formed to be relatively large, since the open-ended spanner must engage around the dihedral and respectively the respective camshaft.

Such an excessively large through-opening of the cylinder head hood can undesirably weaken the cylinder head hood, or the cylinder head hood must be configured to be especially heavy and thus weight and space intensive in the areas that adjoin the respective opening to help with assembly.

Since it is now provided according to the invention to use the described recess instead of a dihedral in order to secure the camshaft against rotation, the opening to help with assembly can be kept especially small. As a result, the cylinder head hood can be sufficiently stably executed in a way that is effective in terms of installation space and weight, as well as being cost-effective. In addition, an especially simple and therefore time and cost-effective assembly can be achieved.

In the invention, a cylinder head hood is mounted on the cylinder head and the camshafts, which, per recess, has a through-opening matched with the respective recess, through which the tool can be inserted. It is provided according to the invention that a first wall area of the cylinder head hood, that at least partially delimits a first of the through-openings, and a second wall area of the cylinder head hood, that at least partially delimits a second of the through-openings, are arranged at different heights.

In an advantageous further development of the invention, the respective recesses of the two camshafts of a cylinder head, in which two camshafts are rotatably mounted, are arranged mirror-symmetrically offset relative to a plane that is perpendicular to the plane that spans the longitudinal central axes of the two camshafts, in particular to the center of the cylinder head. It is thereby also made possible to move the two openings to help with assembly towards the center of the cylinder head, or to keep the total width of an individual opening to help with assembly, that is shared by both camshafts, low.

Preferably, at least one of the openings to help with assembly is, in a fully manufactured internal combustion engine, covered by a component of the engine, for example an ignition coil. An additional covering for the opening to help with assembly that is separate from the component can thereby be avoided, which keeps the costs and the weight of the camshaft bearing assembly, and respectively the internal combustion engine, low.

Further advantages, features and details of the invention arise from the following description of a preferred exemplary embodiment as well as based on the drawings. The features previously mentioned in the description and combinations of features as well as the features mentioned hereinafter in the description of figures and/or features and combinations of features only shown in the figures can be used not only in the respectively given combination, but also in other combinations or alone, without leaving the scope of the invention.

DETAILED DESCRIPTION OF THE DRAWINGS

Figure 1:
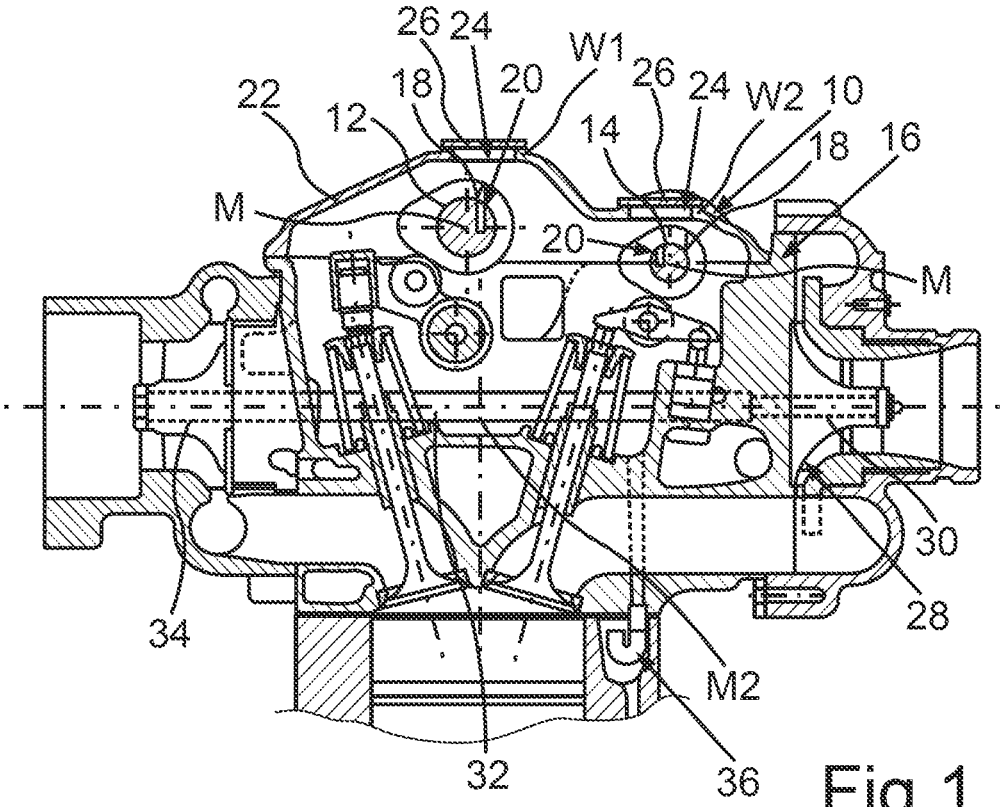
FIG. 1 is a partial front view, that is schematic and cut on a plane that is perpendicular to the plane that spans the longitudinal central axes of the two camshafts, of a bearing assembly according to the invention of two camshafts according to the invention on a cylinder head of an internal combustion engine, in particular for a motor vehicle.

In the figures, elements that are the same or functionally the same are provided with the same reference numerals.

FIG. 1 shows a bearing assembly 10 of a first camshaft 12 and of a second camshaft 14 on a cylinder head 16 of an internal combustion engine of a motor vehicle that is formed as a reciprocating piston engine, in a schematic and cut front view. This means that the motor vehicle, which is preferably formed as a motor car, in particular as a passenger motor car, has, in its fully manufactured form, the internal combustion engine and thus the camshafts 12 and 14, the cylinder head 16 and the bearing assembly 10. In the bearing assembly 10, the camshafts 12 and 14 are mounted rotatably on the cylinder head 16, so that the respective camshaft 12 or 14 is rotatable around a respective axis of rotation, relative to the cylinder head 16. The axes of rotation of the camshafts 12 and 14 run parallel to each other and are distanced from each other. Thus, the respective axis of rotation of the respective camshaft 12 or 14 runs through its respective center, labelled in FIG. 1 as M. Therefore, the axis of rotation coincides with a respective longitudinal axis that runs through the respective center M or a longitudinal central axis of the respective camshaft 12 or 14.

The respective camshaft 12 or 14 has a respective recess 20 configured in a respective outer periphery of the outer surface 18 of the respective camshaft 12 or 14, which recess is configured as a blind hole in the exemplary embodiment shown in the figures. In particular, the respective recess 20 is a bore, in particular a blind-hole bore.

During an assembly of the cylinder head 16 and thus the internal combustion engine overall, a phase adjuster, which is also referred to as a camshaft adjuster, is respectively screwed onto at least one of the camshafts 12 and 14, or on both camshafts 12 and 14, after an installation of the camshafts 12 and 14, i.e., after the camshafts 12 and 14 have been rotatably mounted on the cylinder head 16. A central screw is used to this end, which is screwed at least generally centrally into the respective camshaft 12 or 14, i.e., in the center M of the respective camshaft 12 or 14, and is thus screwed to the respective camshaft 12 or 14, in order to thereby screw the respective camshaft adjuster onto the respective camshaft 12 or 14, and thus to connect it to the respective camshaft 12 or 14. The camshaft adjuster enables the respective camshaft 12 or 14 to rotate relative to a driven shaft, for example configured as a crankshaft, of the internal combustion engine and thus to adjust during its cycle, while the respective camshaft 12 or 14 is coupled in a torque-transmitting manner with the driven shaft and is, for example, driven by the driven shaft.

In order to screw the central screw to the respective camshaft 12 or 14 by means of a tightening torque, and in particular to tighten it, and thereby adjusting a desired angular orientation between the respective camshaft 12 or 14 and the respective camshaft adjuster, the respective camshaft 12 or 14 is locked rigidly to the cylinder head 16 relative to its rotational position, i.e., it is secured against a rotation occurring relative to the cylinder head 16. A tightening torque, by means of which the central screw is screwed and in particular tightened to the respective camshaft 12 or 14, can thereby be supported, so that the central screw can be screwed and in particular tightened to the respective camshaft 12 or 14.

In order to avoid such a rotation of the respective camshaft 12 or 14 occurring relative to the cylinder head 16, the respective camshaft 12 or 14 is locked. To this end, it is in principle conceivable that the respective camshaft 12 or 14 has level surfaces on both sides of its outer periphery, which form a dihedral. By this is in particular to be understood that the level or flat surfaces are arranged on opposite sides, in particular in the radial direction of the camshaft 12 or 14. A tool in the shape of an open-ended spanner, that is also referred to as an open-ended spanner, can be attached on the dihedral and thus on the level surfaces, and can thus be brought into positive cooperation with the respective camshaft 12 or 14. A torque can therefore be transmitted between the open-ended spanner and the respective camshaft 12 or 14, by means of which the camshaft 12 or 14 can be secured against a rotation occurring relative to the cylinder head 16 and thus the previously mentioned tightening torque can be braced or stopped.

It can be identified from FIG. 1 that the internal combustion engine has a cylinder head hood 22 that is formed separately to the cylinder head 16 and is also simply referred to as a hood, which is attached to the cylinder head 16 and the camshafts 12 and 14, and is thus arranged outside the cylinder head 16 and the camshafts 12 and 14. By means of the cylinder head hood 22, the cylinder head 16 and the camshafts 12 and 14 are respectively at least partially, in particular at least largely, covered and thus protected upwards in the vertical direction of the internal combustion engine. The hood thereby has, for example per dihedral and thus per camshaft 12 or 14, a respective through-opening 24. During use of the previously described open-ended spanner, the respective through-opening 24 must be sufficiently large, that the open-ended spanner can reach through the through-opening 24 and subsequently be attached to the respective dihedral, i.e., be brought into positive cooperation with the respective dihedral. During use of the open-ended spanner, the through-opening 24 must be executed to be relatively large, since the open-ended spanner must engage around the respective camshaft 12 or 14 and its jaws must be powerfully dimensioned, for absorbing the torque. If two camshafts 12 and 14 are provided, the therefore necessary two through-openings 24 occupy, side by side, almost the whole width of the cylinder head hood 22.

In order to then be able to achieve on the one hand an especially easy assembly, and on the other hand to be able to avoid an undesirable weakening of the cylinder head hood 22, the previously mentioned dihedral is, for instance, not provided, but rather the respective camshaft 12 or 14 has the respective recess 20, into which a tool, that is in particular different from an open-ended spanner, can be inserted and thereby brought into positive cooperation with the respective camshaft 12 or 14, whereby the camshaft 12 or 14 can be secured against a rotation occurring relative to the cylinder head 16 by means of the tool. The respective recess 20, for example formed as a bore, is thus arranged offset from the respective center M of the respective camshaft 12 or 14 in the radial direction of the respective camshaft 12 or 14. The through-openings 24, which are also simply referred to as openings, can thereby be configured to be especially small, whereby an excessive weakening of the cylinder head hood 22 can be avoided.

Both recesses 20 are arranged mirror-symmetrically offset relative to a plane that is perpendicular to the plane that spans the longitudinal central axes of the two camshafts (12, 14). This mirror-symmetrical arrangement leads to the two recesses 20 having a shorter distance between each other than the two longitudinal central axes of the camshafts (12, 14). Therefore, both through-openings 24 are also less distanced than the two longitudinal central axes of the camshafts (12, 14).

It can be identified from FIG. 1 that the respective through-opening 24, in particular in the fully manufactured form of the internal combustion engine, is sealed by means of a respective cover 26. It is also provided that a first wall area W1, that at least partially delimits a first of the through-openings 24, which at least mostly, in particularly completely, preferably surrounds and thus delimits the first through-opening 24, and a second wall area W2 of the cylinder head hood 22, which at least partially, in particular at least mostly or completely surrounds and thus delimits the second through-opening 24, in particular in the vertical direction of the internal combustion engine, are arranged at different heights. The wall areas W1 and W2 are thereby herein formed integrally with each other. The wall areas W1 and W2 are also referred to as flanks. In particular, the through-openings 24 are arranged in respective imagined planes that are distanced from each other, which are in particular distanced from each other in the vertical direction of the internal combustion engine. The through-openings 24 are thus arranged on the previously mentioned, differing heights.

In comparison to conventional solutions, the through-openings 24 can be significantly smaller, i.e., they can be configured as significantly smaller openings to help with assembly. Materials and thus weight and costs can be spared if the heights of the wall areas W1 and W2, also referred to as flank heights, and thus the through-openings 24 are different in terms of optimized load-bearing capacity, so that the openings are arranged at differing heights and/or if the wall areas W1 and W2 (flanks) are executed with differing thicknesses or strengths. In simple internal combustion engines, also referred to as motors or internal combustion motors, whose camshafts 12 and 14 rotate in opposite directions or have opposite directions of rotation, the central screws are rotated with different directions of rotation and thus by means of a right-hand thread and by means of a left-hand thread and thereby screwed and tightened or torqued. Therefore, working directions of the supporting tightening torques are opposite to each other. A mirror-symmetrical embodiment of the recesses 20, also referred to as locking openings, enables a load-orientated design for both camshafts 12 and 14. The wall areas that delimit the recess (20) are differently dimensioned relative to their height and wall thickness. It is also provided in the exemplary embodiment shown in the Figures that the recesses 20 are arranged at different heights. The centers M are also arranged at different heights.

If the recesses 20 are offset towards the cylinder or cylinder head center, as is shown in FIG. 1, the respective ignition coils can, for example, be arranged towards the center and thereby further away from an exhaust turbocharger. This keeps their thermal load low. If the recesses 20, also referred to as support openings, are arranged mirror-symmetrically to the cylinder or cylinder head center, both through-openings 24, also referred to as openings to help with assembly, collectively occupy an especially low width in or on the cylinder head hood 22. If a further component covers the respective opening to help with assembly, the respective cover 26, also referred to as a closure cover, can be avoided.

The previously mentioned cylinder head center can be identified in FIG. 1 and is labelled with M2. The previously mentioned exhaust turbocharger, which is labelled with 28 in FIG. 1, is also identifiable, and has a compressor wheel 30, a shaft 32 also referred to as a turbocharger shaft and a turbine wheel 34 that can be driven by exhaust from the internal combustion engine. The compressor wheel 30 and the turbine wheel 34 are wheels, which are each rotatably connected with the shaft 32. Therefore, the compressor wheel 30 can be driven by the shaft 32 of the turbine wheel 34, by means of which air that is supplied to at least one combustion chamber of the internal combustion engine is compressed. An oil backflow 36 with a pipe elbow can also be identified from FIG. 1.

Figure 2:
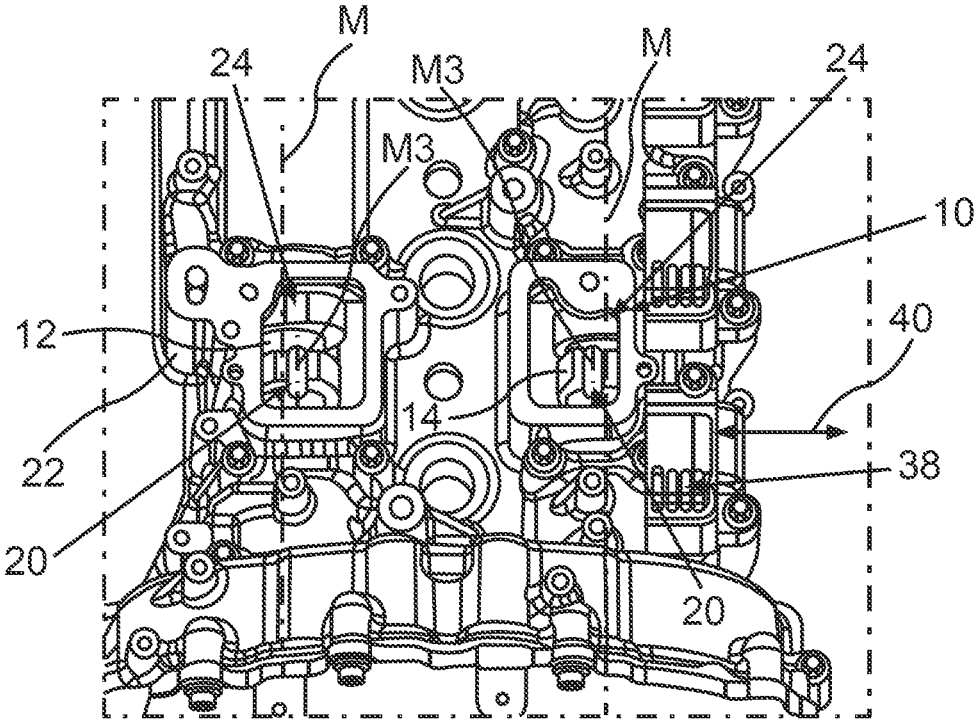
FIG. 2 is a partial schematic top view of the bearing assembly.

FIG. 2 shows a partial schematic top view of the bearing assembly 10. Therefore, one of the previously mentioned ignition coils can be identified in FIG. 2 and is labelled with 38. A distance of the ignition coil 38 from an exhaust system of the internal combustion engine, through which exhaust from the combustion chamber can flow, is illustrated by a double-headed arrow 40 in FIG. 2. Moreover, it is, for example, provided that the camshaft 12 is an intake camshaft and the camshaft 14 is an outlet camshaft. According to FIG. 2, the respective recess 20 is also formed as a groove, the respective center of which is labelled with M3 in FIG. 2. It is especially clearly identifiable from FIG. 2 that the respective recess 20, in particular its respective center M3, of the respective camshaft 12 or 14 is arranged mirror-symmetrically offset towards the respective other camshaft 14 or 12 and thus towards the cylinder head center M2 in the radial direction of the respective camshaft 12 or 14. The same applies for the respective through-opening 24, in particular its respective center, in particular relative to the respective center M of the respective camshaft 12 or 14.

LIST OF REFERENCE CHARACTERS

10 Bearing assembly
12 Camshaft
14 Camshaft
16 Cylinder head
18 Outer periphery of the outer surface

20 Recess
22 Cylinder head hood
24 Through-opening
26 Cover
28 Exhaust turbocharger
30 Compressor wheel
32 Shaft
34 Turbine wheel
36 Oil backflow
38 Ignition coil
40 Double-headed arrow
M Center
M2 Center
M3 Center
W1 Wall area
W2 Wall area

The invention claimed is:

1. An apparatus, comprising:

a bearing assembly (10) of a first camshaft (12) and a second camshaft (14) on a cylinder head (16) of an internal combustion engine of a motor vehicle, wherein the first and second camshafts (12, 14) are mounted rotatably on the cylinder head (16);

wherein the first camshaft (12) has a first recess (20) that is formed in an outer periphery of an outer surface (18) of the first camshaft (12) and opens outwards in a radial direction of the first camshaft (12), wherein a tool is insertable into the first recess (20) and can be brought into positive cooperation with the first camshaft (12) such that the first camshaft (12) can be secured against rotating by the tool, and wherein the first recess (20) is disposed offset from a center of the first camshaft (12) in the radial direction;

wherein the second camshaft (14) has a second recess (20) that is formed in an outer periphery of an outer surface (18) of the second camshaft (14) and opens outwards in a radial direction of the second camshaft (14), wherein the tool is insertable into the second recess (20) and can be brought into positive cooperation with the second camshaft (14) such that the second camshaft (14) can be secured against rotating by the tool, and wherein the second recess (20) is disposed offset from a center of the second camshaft (14) in the radial direction;

a cylinder head hood (22), wherein the cylinder head hood (22) is attached to the cylinder head (16), wherein the cylinder head hood (22) has a first through-opening (24) matched with the first recess (20) through which the tool is insertable, and wherein the cylinder head hood (22) has a second through-opening (24) matched with the second recess (20) through which the tool is insertable;

wherein a first wall area (W1) of the cylinder head hood (22) that at least partially delimits the first through-opening (24) and a second wall area (W2) of the cylinder head hood (22) that at least partially delimits the second through-opening (24) are disposed at different heights in a vertical direction of the internal combustion engine of the motor vehicle.

2. The apparatus according to claim 1, wherein the first and second wall areas (W1, W2) are formed integrally with each other.

3. The apparatus according to claim 1, wherein the first and second through-openings (24) are covered by a component of the internal combustion engine.

4. The apparatus according to claim 3, wherein the component is an ignition coil.

* * * * *